US006012570A

United States Patent [19]

Ovadia et al.

[11] Patent Number: 6,012,570

[45] Date of Patent: Jan. 11, 2000

[54] MEMBER FOR HOLDING DOWN JEWELRY ITEMS ON A JEWELRY PAD

[75] Inventors: Joseph Ovadia, Little Falls; Wojciech Doliwa, Garfield, both of N.J.

[73] Assignee: Ovadia Corp., Little Falls, N.J.

[21] Appl. No.: 09/197,188

[22] Filed: Nov. 20, 1998

[51] Int. Cl.[7] ..... A45C 11/04

[52] U.S. Cl. ..... 206/6.1; 206/566; 206/565; 206/493

[58] Field of Search ..... 206/6.1, 566, 565, 206/480, 301, 483, 493, 18

[56] References Cited

U.S. PATENT DOCUMENTS

| | | | |
|---|---|---|---|
| 555,322 | 2/1896 | Marsh | 206/480 |
| 1,802,037 | 4/1931 | Smith | 206/480 |
| 3,400,812 | 9/1968 | Snow | 206/483 |
| 3,964,603 | 6/1976 | Sandler | 206/6.1 |
| 4,082,183 | 4/1978 | Sturm | 206/301 |
| 4,511,041 | 4/1985 | Waitzman | 206/566 |

*Primary Examiner*—Paul T. Sewell
*Assistant Examiner*—Nhan T. Lam
*Attorney, Agent, or Firm*—Richard M. Goldberg

[57] ABSTRACT

A combination jewelry pad and hold down member for holding down a jewelry item on the jewelry pad, includes a jewelry pad having an upper wall with an opening therethrough; and a hold down member including an L-shaped clip member including a hold down wall for engaging and holding down a jewelry item on an upper surface of an upper wall of a jewelry pad, and an upstanding wall insertable through an opening in the jewelry pad and having one end connected to the hold down wall; two spring members; and a connecting wall connecting together the two spring members in parallel, spaced apart relation and connected to an opposite end of the upstanding wall, each spring member including a central section connected with the connecting wall, a first spring section connected with the central section at a position spaced below the hold down wall, and a second spring section connected with the central section at a side of the central section which is opposite the first spring section, the first and second spring sections each including an arcuate leaf spring having a free end for engagement with an underside of the upper wall of the jewelry pad so as to downwardly bias the hold down wall into clamping engagement with the jewelry item.

22 Claims, 2 Drawing Sheets

MEMBER FOR HOLDING DOWN JEWELRY ITEMS ON A JEWELRY PAD

BACKGROUND OF THE INVENTION

The present invention relates generally to display devices, and more particularly, is directed to a member for holding down jewelry items on a jewelry pad.

It is conventional for jewelry to be displayed on jewelry pads and/or jewelry trays. In either case, the pads and trays have been made from plastic, cardboard or foam rubber, and are usually covered with some kind of fabric or flocking to give a plush look for the aesthetic demands of the jewelry display, with a layer of foam under the flocking or fabric.

For example, a ring tray is known having a rectangular frame with a central rectangular opening therein and an inwardly extending peripheral ledge. A bottom closing member is secured to the tray so as to close the underside of the tray, and is formed with a plurality of recesses therein in a generally honeycomb pattern. A top pad is secured to and closes the top of the tray. In this known ring tray, the top pad includes a thin lower sheet made of a rubber or similar material that is glued to the peripheral ledge of the frame, the lower sheet having a plurality of die cut slits formed therein which are aligned with each recess. In this manner, a ring can be pushed through a slit in the lower sheet so that it is held by the rubber material and seats in a recess. In order to provide an aesthetic appearance, an upper fabric pad having a plurality of openings is adhered to the upper surface of the lower sheet so that openings in the upper fabric pad are aligned with the slits in the lower sheet.

However, with such known ring tray, one-half of the ring is hidden from view in the top pad where it is held. Further, such arrangement is unnecessarily costly and not entirely effective.

Other ring trays and pads are known having ring posts extending at an angle from the tray or pad and on which a ring is mounted. However, such structures result in additional material costs and more complicated constructions. Further, the ring posts always extend upwardly, thereby making it difficult to stack such trays or pads for storage.

OBJECTS AND SUMMARY OF THE INVENTION

Accordingly, it is an object of the present invention to provide a member for holding down jewelry items on a jewelry pad that overcomes the problems with the aforementioned prior art.

It is a principal object of the present invention to provide a member for holding down rings on a jewelry pad in a clip-like manner.

It is another object of the present invention to provide a member for holding down rings on a jewelry pad in which substantially the entire ring is viewable on the jewelry pad.

It is still another object of the present invention to provide a member for holding down rings on a jewelry pad in which the member is removably fit through a small opening in the jewelry pad.

It is yet another object of the present invention to provide a member for holding down jewelry items on a jewelry pad in which the member is made in an integrally molded, one-piece structure.

It is a further object of the present invention to provide a member for holding down jewelry items on a jewelry pad which is easy and inexpensive to use and manufacture.

In accordance with an aspect of the present invention, a hold down member for holding down a jewelry item on a jewelry pad, includes an L-shaped clip member including a hold down wall for engaging and holding down a jewelry item on an upper surface of an upper wall of a jewelry pad, and an upstanding wall insertable through an opening in the jewelry pad and having one end connected to the hold down wall; and at least one spring member connected to an opposite end of the upstanding wall and engageable with an underside of the upper wall of the jewelry pad for biasing the hold down wall so as to hold the jewelry item on the upper wall of the jewelry pad.

Each spring member includes a central section connected with the upstanding wall, and a first spring section connected with the central section at a position spaced below the hold down wall. The first spring section includes an arcuate leaf spring having a free end for engagement with an underside of the upper wall of the jewelry pad so as to downwardly bias the hold down wall into clamping engagement with the jewelry item.

Each spring member also includes a second spring section connected with the central section at a side of the central section which is opposite the first spring section. The first spring section includes an arcuate leaf spring having a free end for engagement with an underside of the upper wall of the jewelry pad so as to downwardly bias the hold down wall into clamping engagement with the jewelry item.

The hold down wall has a free end which is upturned to aid in insertion of a jewelry item between the hold down wall and the upper wall of the jewelry pad. Preferably, jewelry item includes a ring.

In accordance with another aspect of the present invention, a hold down member for holding down a jewelry item on a jewelry pad, includes an L-shaped clip member including a hold down wall for engaging and holding down a jewelry item on an upper surface of an upper wall of a jewelry pad, and an upstanding wall insertable through an opening in the jewelry pad and having one end connected to the hold down wall; two spring members engageable with an underside of the upper wall of the jewelry pad; and a connecting wall connecting together the two spring members in parallel, spaced apart relation and connected to an opposite end of the upstanding wall.

The connecting wall is connected substantially centrally to the spring members.

In accordance with still another aspect of the present invention, a combination jewelry pad and hold down member for holding down a jewelry item on the jewelry pad, includes a jewelry pad having an upper wall with an opening therethrough; and a hold down member including an L-shaped clip member including a hold down wall for engaging and holding down a jewelry item on an upper surface of the upper wall of the jewelry pad, and an upstanding wall insertable through the opening in the jewelry pad and having one end connected to the hold down wall; and at least one spring member connected to an opposite end of the upstanding wall and engageable with an underside of the upper wall of the jewelry pad for biasing the hold down wall so as to hold the jewelry item on the upper wall of the jewelry pad.

The above and other objects, features and advantages of the invention will become readily apparent from the following detailed description thereof which is to be read in connection with the accompanying drawings. dr

DETAILED DESCRIPTION

Figure 1:
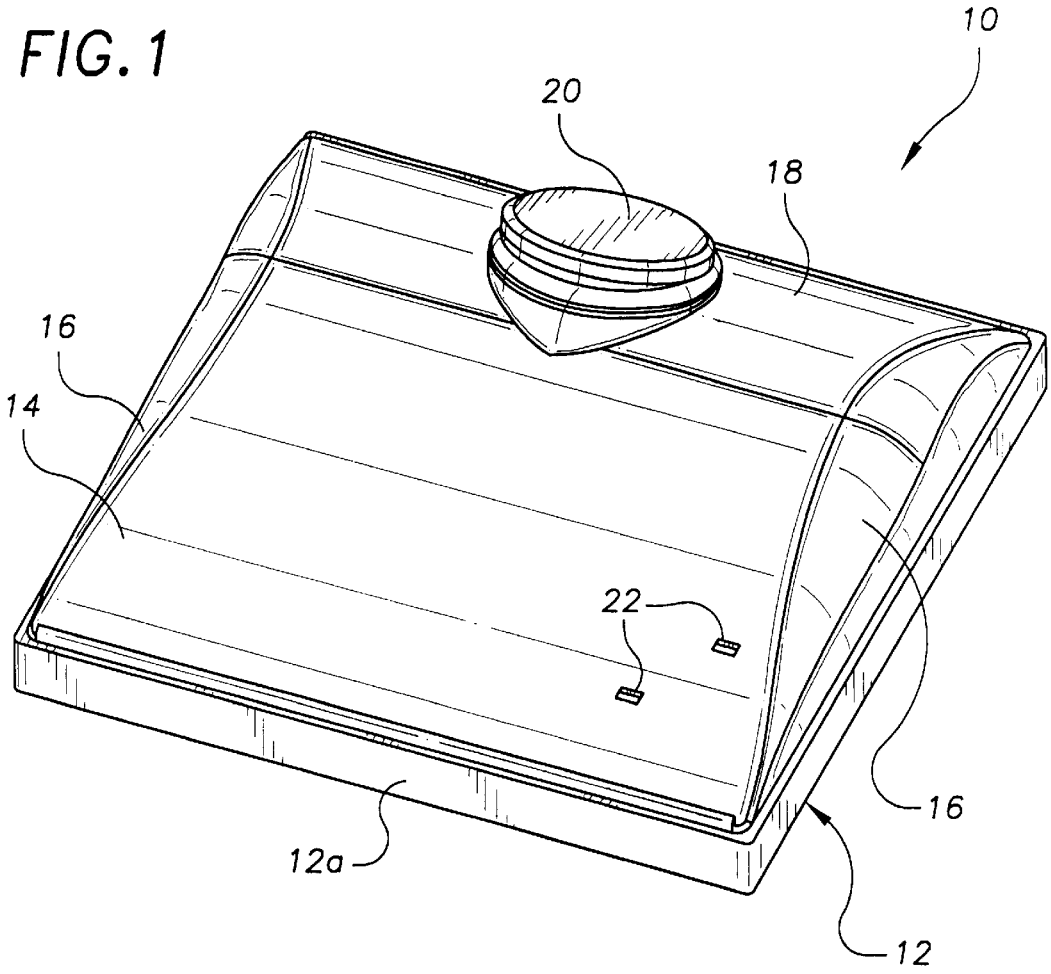
FIG. 1 is a perspective view of a jewelry pad according to present invention, for use with a member for holding down jewelry items on the jewelry pad.
Figure 4:
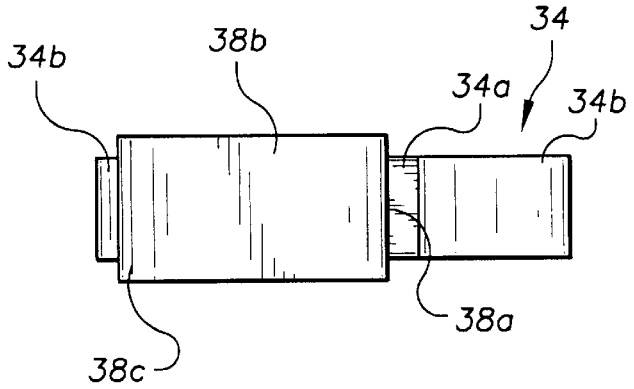
FIG. 4 is a top plan view of a member for holding down jewelry items according to another embodiment of the present invention.

Referring to the drawings in detail, and initially to FIG. 1 thereof, a deformable and resilient jewelry pad 10 according to the present invention includes a peripheral rectangular base wall 12 that supports jewelry pad 10 on a flat surface. A substantially rectangular upper inclined wall 14 extends upwardly and rearwardly from the upper edge of a front wall 12*a* of base wall 12 at an inclination of about 20° to a ground surface. The angular orientation provides an improved view of the jewelry items to be displayed. Inclined wall 14 can have a slightly convex bowed configuration. Triangular side walls 16, each having an upper inclined edge are connected between a respective side edge of inclined wall 14, a top edge of base wall 12 and a rear wall 18. As shown, rear wall 18 is inclined rearwardly and downwardly. In addition, rear wall 18 has a slightly concave bowed configuration.

Preferably, each pad 10 is made from a flexible plastic material that can be deformed but which retains its shape when the deformation force is removed. Alternatively, each pad 10 can be made of a rubber or any other suitable material. In any event, each pad 10 is made of a high memory material with a substantially thin, constant thickness throughout. Because pads 10 have a substantially constant thickness throughout, they are thin and therefore easily deformable, while reducing the amount of material that is used. Alternatively, pad 10 can be rigid and can take any suitable shape, such as a flat surface, etc.

Pad 10 includes a cylindrical molded projection 20 as part of the integrally molded, one-piece construction, and about which a necklace (not shown) can be placed, such that the necklace drapes over the upper surface of inclined wall 14 for viewing.

In accordance with an aspect of the present invention, in order to display rings along with the necklace, two small rectangular openings 22 are provided in inclined wall 14, the purpose for which will become apparent hereinafter.

Figure 2:
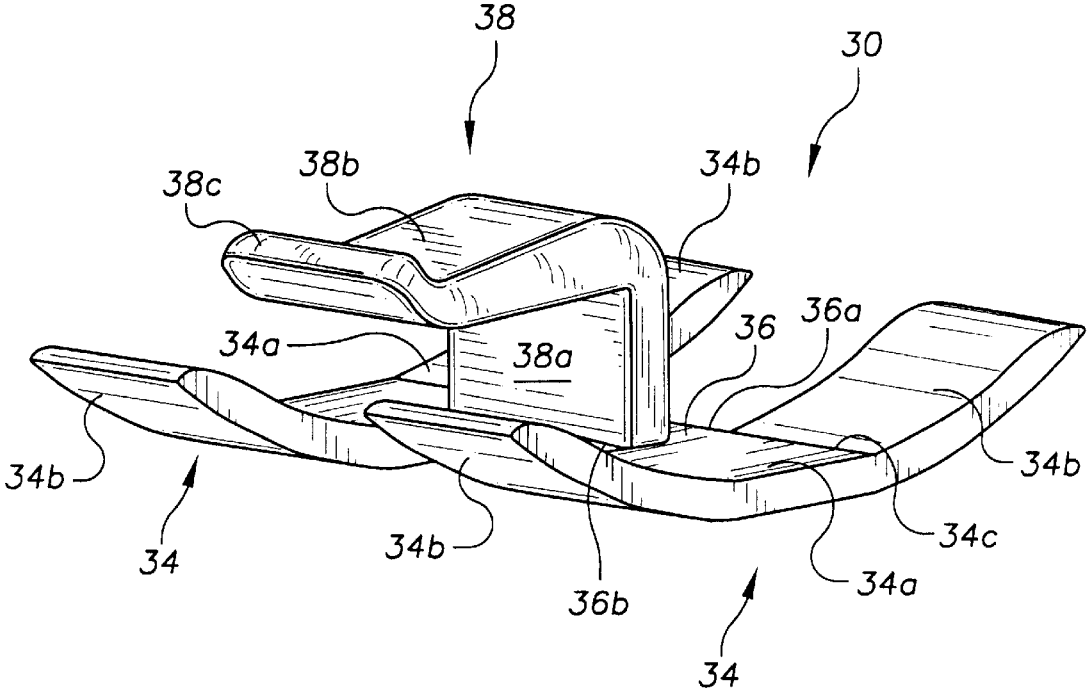
FIG. 2 is a perspective view of the member for holding down jewelry items on the jewelry pad of FIG. 1.
Figure 3:
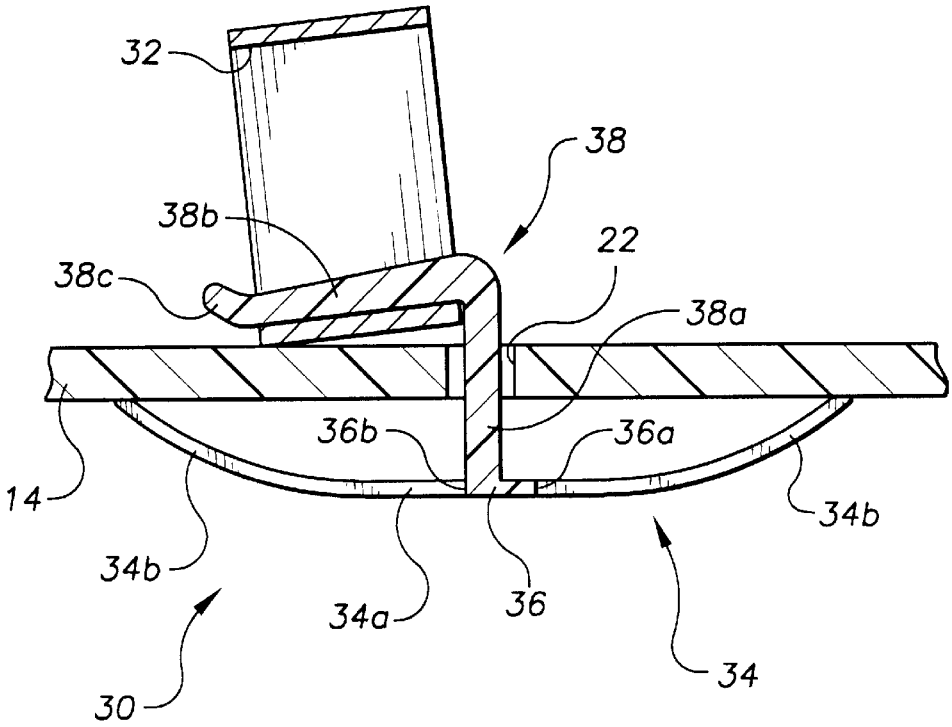
FIG. 3 is a cross-sectional view of the member of FIG. 2, shown holding down a ring on the jewelry pad of FIG. 1.

Referring now to FIGS. 2 and 3, there is shown a hold down member 30 according to the present invention for insertion into an opening 22 in order to hold down a ring 32 on the upper surface of inclined wall 14.

Specifically, hold down member 30 includes spring element formed by two parallel, spaced apart elongated spring members 34 connected together at central portions thereof by a connecting wall 36. Each spring member 34 includes a flat or planar central section 34*a* and opposite upwardly arcuate leaf spring sections 34*b* connected to opposite ends of central section 34*a* and in line with each other. Central sections 34*a* are connected together by connecting wall 36. Specifically, connecting wall 36 has a length equal to one-half the length of each central section 34*a* and has a first edge 36*a* in alignment with one edge 34*c* of each central section 34*a*. As a result, the opposite second edge 36*b* of connecting wall 36 is positioned at a mid-point of each central section 34*a*, and thereby at the center of member 30.

Hold down member 30 further includes an L-shaped clip member 38 secured at second edge 36*b* of connecting wall 36. Specifically, clip member 38 includes a first upstanding wall 38*a* which extends upwardly at a right angle from second edge 36*b* of connecting wall 36, and a second hold down wall 38*b* which has one end connected to the upper end of upstanding wall 38*a* and extends at a slightly less than right angle therefrom in a direction away from connecting wall 36. Upstanding wall 38*a* has a height such that hold down wall 38*b* extends higher than the opposite free ends of spring sections 34*b*. In addition, the free end 38*c* of hold down wall 38*b* may be upturned in order to permit easy entry of a ring 32 beneath hold down wall 38*b*, as will be understood from the discussion which follows.

Also, hold down wall 38*b* preferably decreases in width from its connected end toward free end 38*c*. Hold down wall 38*b* is slightly inclined downwardly from upstanding wall 38*a* toward free end 38*c*. As a result, there is a greater thickness at the juncture of upstanding wall 38*a* and hold down wall 38*b* in order to prevent breaking off of hold down wall 38*b* during flexing thereof.

Hold down member 30 is made as a unitary, single-piece construction from a plastic material in a molding operation. Thus, although there is some rigidity to hold down member 30, spring sections 34*b* and hold down wall 38*b* can flex, and are resilient so as to return to their original configurations when an outside force is removed.

In use, free end 38*c* and hold down wall 38*b* are inserted into an opening 22, so that hold down member 30 assumes the position shown in FIG. 3. As shown, the free ends of spring sections 34*b* engage the underside of inclined wall 14. Initially, there is some separation or space between hold down wall 38*b* and the upper surface of inclined wall 14. Ring 32 is then inserted between hold down wall 38*b* and the upper surface of inclined wall 14. Since the thickness of ring 32 is generally greater than the space between hold down wall 38*b* and the upper surface of inclined wall 14, this causes hold down wall 38*b* to be raised up away from inclined wall 14. As a result, there is a deformation or flattening out of spring sections 34*b*, whereby hold down wall 38*b* is forced into holding contact with ring 32 by the force of spring sections 34*b*. In this orientation, ring 32 is forced by hold down wall 38*b* at a display angle from inclined wall 14, and substantially all of ring 32 is viewable. At the same time, since only hold down wall 38*b* extends above inclined wall 14, there is very little obstruction of ring 32.

While the present invention has been discussed in relation to rings, it can just as well be used with other jewelry items, such as earrings, pendants, etc.

Further, it will be appreciated that other modifications within the scope of the invention can be provided. For example, a single spring member 34 could be provided as the spring element, in which the lower end of upstanding wall 38*a* is connected directly to the center of central section 34*a* of the single spring member 34.

As another modification, each spring member 34, whether a single spring member or the two parallel, spaced apart spring members, can include only one spring section 34*b* which is positioned below hold down wall 38*b*. In such case, hold down member 30 would be provided in an essentially U-shape.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A hold down member for holding down a jewelry item on a jewelry pad, comprising:

an L-shaped clip member including:

a substantially planar hold down wall adapted to engage and hold down a jewelry item on an upper surface of an upper wall of a jewelry pad, and an upstanding wall having one end connected to said hold down wall to form a substantially L-shaped configuration between said upstanding wall and said hold down wall, said upstanding wall adapted to be inserted through an opening in the jewelry pad; and a spring element connected to an opposite end of said upstanding wall and adapted to engage with an underside of the upper wall of the jewelry pad for biasing said hold down wall so as to hold the jewelry item on the upper wall of the jewelry pad, said spring element being disposed entirely at a lower level than said substantially planar hold down wall and being substantially parallel thereto, said spring element including:

a central section connected with said opposite end of said upstanding wall, and a spring section connected with said central section and extending to a position spaced entirely at a lower level than said substantially planar hold down wall, said first spring section including an arcuate leaf spring having a free end for engagement with an underside of the upper wall of the jewelry pad so as to downwardly bias said hold down wall into clamping engagement with the jewelry item.

2. A hold down member for holding down a jewelry item on a jewelry pad, comprising:

an L-shaped clip member including:

a hold down wall adapted to engage and hold down a jewelry item on an upper surface of an upper wall of a jewelry pad, and an upstanding wall having one end connected to said hold down wall to form a substantially L-shaped configuration between said upstanding wall and said hold down wall, said upstanding wall adapted to be inserted through an opening in the jewelry pad; and a spring element connected to an opposite end of said upstanding wall and adapted to engage with an underside of the upper wall of the jewelry pad for biasing said hold down wall so as to hold the jewelry item on the upper wall of the Jewelry pad, said spring element including:

a central section connected with said upstanding wall, a first spring section connected with said central section at a position spaced below said hold down wall, and a second spring section connected with said central section at a side of said central section which is opposite said first spring section.

3. A hold down member according to claim 2, wherein each of said first and second spring sections includes an arcuate leaf spring having a free end for engagement with an underside of the upper wall of the jewelry pad so as to downwardly bias said hold down wall into clamping engagement with the jewelry item.

4. A hold down member according to claim 3, wherein said hold down wall has a free end which is upturned to aid in insertion of a jewelry item between said hold down wall and the upper wall of said jewelry pad.

5. A hold down member for holding down a jewelry item on a jewelry pad, comprising:

an L-shaped clip member including:

a hold down wall adapted to engage and hold down a jewelry item on an upper surface of an upper wall of a jewelry pad, and an upstanding wall having one end connected to said hold down wall to form a substantially L-shaped configuration between said upstanding wall and said hold down wall, said upstanding wall adapted to be inserted through an opening in the jewelry pad;

two spring members adapted to engage with an underside of the upper wall of the jewelry pad; and a connecting wall connecting together said two spring members in parallel, spaced apart relation and connected to an opposite end of said upstanding wall.

6. A hold down member according to claim 5, wherein said connecting wall is connected substantially centrally to said spring members.

7. A hold down member according to claim 5, wherein each said spring member includes:

a central section connected with said upstanding wall, and a first spring section connected with said central section at a position spaced below said hold down wall.

8. A hold down member according to claim 7, wherein said first spring section includes an arcuate leaf spring having a free end for engagement with an underside of the upper wall of the jewelry pad so as to downwardly bias said hold down wall into clamping engagement with the jewelry item.

9. A hold down member according to claim 7, wherein each said spring member includes a second spring section connected with said central section at a side of said central section which is opposite said first spring section.

10. A hold down member according to claim 9, wherein said second spring section includes an arcuate leaf spring having a free end for engagement with an underside of the upper wall of the jewelry pad so as to downwardly bias said hold down wall into clamping engagement with the jewelry item.

11. A hold down member according to claim 5, wherein said hold down wall has a free end which is upturned to aid in insertion of a jewelry item between said hold down wall and the upper wall of said jewelry pad.

12. A combination jewelry pad and hold down member for holding down a jewelry item on the jewelry pad, comprising:

a jewelry pad having an upper wall with an opening therethrough; and a hold down member including:

an L-shaped clip member including:

a hold down wall for engaging and holding down a jewelry item on an upper surface of an upper wall of a jewelry pad, and an upstanding wall having one end connected to said hold down wall to form a substantially L-shaped configuration between said upstanding wall and said hold down wall, said upstanding wall adapted to be inserted through an opening in the jewelry pad; and a spring element connected to an opposite end of said upstanding wall and engageable with an underside of the upper wall of the jewelry pad for biasing said hold down wall so as to hold the jewelry item on the upper wall of the jewelry pad.

13. A combination jewelry pad and hold down member according to claim 12, wherein said spring element includes:

a central section connected with said upstanding wall, and a first spring section connected with said central section at a position spaced below said hold down wall.

14. A combination jewelry pad and hold down member according to claim 13, wherein said first spring section includes an arcuate leaf spring having a free end for engagement with an underside of the upper wall of the jewelry pad so as to downwardly bias said hold down wall into clamping engagement with the jewelry item.

15. A combination jewelry pad and hold down member according to claim 13, wherein said spring element includes a second spring section connected with said central section at a side of said central section which is opposite said first spring section.

16. A combination jewelry pad and hold down member according to claim 15, wherein said second spring section includes an arcuate leaf spring having a free end for engagement with an underside of the upper wall of the jewelry pad so as to downwardly bias said hold down wall into clamping engagement with the jewelry item.

17. A combination jewelry pad and hold down member according to claim 12, wherein said spring element includes:

two spring members adapted to engage with an underside of the upper wall of the jewelry pad; and a connecting wall connecting together said two spring members in parallel, spaced apart relation and connected to an opposite end of said upstanding wall.

18. A combination jewelry pad and hold down member according to claim 17, wherein each said spring member includes:

a central section connected with said upstanding wall, and a first spring section connected with said central section at a position spaced below said hold down wall.

19. A combination jewelry pad and hold down member according to claim 18, wherein said first spring section includes an arcuate leaf spring having a free end for engagement with an underside of the upper wall of the jewelry pad so as to downwardly bias said hold down wall into clamping engagement with the jewelry item.

20. A hold down member according to claim 18, wherein each said spring member includes a second spring section connected with said central section at a side of said central section which is opposite said first spring section.

21. A hold down member according to claim 20, wherein said second spring section includes an arcuate leaf spring having a free end for engagement with an underside of the upper wall of the jewelry pad so as to downwardly bias said hold down wall into clamping engagement with the jewelry item.

22. A hold down member according to claim 17, wherein said hold down wall has a free end which is upturned to aid in insertion of a jewelry item between said hold down wall and the upper wall of said jewelry pad.

* * * * *